US009743699B2

(12) United States Patent
Peterson

(10) Patent No.: US 9,743,699 B2
(45) Date of Patent: Aug. 29, 2017

(54) HEADGEAR ACCESSORY

(71) Applicant: Bright Sky Ventures, LLC, Wailea, HI (US)

(72) Inventor: Paul Rodney Peterson, Wailea, HI (US)

(73) Assignee: Bright Sky Ventures, LLC, Wailea, HI (US)

( * ) Notice: Subject to any disclaimer, the term of this patent is extended or adjusted under 35 U.S.C. 154(b) by 0 days.

(21) Appl. No.: 14/537,249

(22) Filed: Nov. 10, 2014

(65) Prior Publication Data

US 2015/0059054 A1 Mar. 5, 2015

Related U.S. Application Data

(63) Continuation-in-part of application No. 29/419,583, filed on Apr. 30, 2012, now Pat. No. Des. 717,525, and a continuation-in-part of application No. 29/419,593, filed on Apr. 30, 2012, now Pat. No. Des. 730,628, and a continuation-in-part of application No. 29/419,596, filed on Apr. 30, 2012, now Pat. No. Des. 717,024.

(51) Int. Cl.
*A42B 1/06* (2006.01)

(52) U.S. Cl.
CPC ..... *A42B 1/067* (2013.01)

(58) Field of Classification Search
CPC .. A42B 1/18; A42B 1/205; A42B 1/24; A42B 1/064; A42B 1/06
See application file for complete search history.

(56) References Cited

U.S. PATENT DOCUMENTS

| | | | | |
|---|---|---|---|---|
| 1,542,561 | A * | 6/1925 | Laskin | A47G 9/0253 24/455 |
| 5,070,545 | A * | 12/1991 | Tapia | 40/329 |
| 5,081,717 | A | 1/1992 | Shedd et al. | |
| 5,323,491 | A | 6/1994 | Barrett | |
| 5,355,535 | A | 10/1994 | Bruder | |
| 5,400,440 | A | 3/1995 | Clifford | |
| 5,448,778 | A | 9/1995 | Phillips | |
| 5,655,225 | A | 8/1997 | Mathers | |

(Continued)

OTHER PUBLICATIONS

U.S. Appl. No. 29/419,593, filed Apr. 30, 2012, Headgear Accessory.

(Continued)

*Primary Examiner* — Shaun R Hurley
*Assistant Examiner* — Andrew W Sutton
(74) *Attorney, Agent, or Firm* — Schwegman Lundberg & Woessner, P.A.

(57) ABSTRACT

A headgear accessory that can be utilized with headgear to provide the wearer with sun protection along the back of the head and neck are disclosed. According to one example, the headgear accessory can have a shade and an attachment member. The shade can be configured of a formable material adapted to cover a rear portion of the head and a rear portion of the neck of a wearer. The shade can have at least one aperture disposed adjacent a first end thereof. The attachment mechanism can include a snap configured to be insertable in the at least one aperture and a spring loaded grasping mechanism adapted to couple with the snap to attach the spring loaded grasping mechanism to the shade.

10 Claims, 5 Drawing Sheets

(56) References Cited

U.S. PATENT DOCUMENTS

| | | | | |
|---|---|---|---|---|
| 5,669,075 | A | 9/1997 | Weeks | |
| D433,784 | S | 11/2000 | Huang | |
| 6,233,745 | B1 | 5/2001 | Friesen | |
| 6,550,064 | B2 | 4/2003 | Schmitt et al. | |
| D481,198 | S | 10/2003 | Mcknight | |
| D504,004 | S | 4/2005 | Cashin | |
| 6,966,072 | B1 | 11/2005 | Kobayashi | |
| 6,996,852 | B1 * | 2/2006 | Cabrera | 2/172 |
| 7,310,829 | B1 | 12/2007 | Engel-Wilson et al. | |
| D591,485 | S | 5/2009 | Cho | |
| D594,186 | S | 6/2009 | Petty | |
| D627,521 | S | 11/2010 | Lofton | |
| D627,933 | S | 11/2010 | Lofton | |
| D666,366 | S | 8/2012 | Votel et al. | |
| 8,418,271 | B2 | 4/2013 | Hardy | |
| D717,024 | S | 11/2014 | Hines et al. | |
| D717,525 | S | 11/2014 | Peterson et al. | |
| D730,628 | S * | 6/2015 | Peterson et al. | D2/891 |
| 2005/0108857 | A1 * | 5/2005 | Wartian et al. | 24/10 R |
| 2005/0223525 | A1 * | 10/2005 | Wartian et al. | 24/3.12 |
| 2006/0174396 | A1 | 8/2006 | Rosas | |
| 2009/0064393 | A1 | 3/2009 | Lambertz | |
| 2013/0180029 | A1 | 7/2013 | Danner | |
| 2015/0059054 | A1 * | 3/2015 | Peterson | 2/172 |

OTHER PUBLICATIONS

"U.S. Appl. No. 29/419,583, Notice of Allowance mailed Jul. 7, 2014", 10 pgs.

"U.S. Appl. No. 29/419,593, Non Final Office Action mailed Jul. 7, 2014", 8 pgs.

"U.S. Appl. No. 29/419,593, Response filed Nov. 7, 2014 to Non Final Office Action mailed Jul. 7, 2014", 6 pgs.

"U.S. Appl. No. 29/419,596, Examiner Interview Summary mailed Apr. 1, 2014", 3 pgs.

"U.S. Appl. No. 29/419,596, Notice of Allowance mailed Jul. 7, 2014", 10 pgs.

* cited by examiner

HEADGEAR ACCESSORY

CROSS-REFERENCE TO RELATED APPLICATIONS

This patent application is a continuation-in-part of U.S. Design application Ser. Nos. 29/419,583 (now U. S. Design Pat. D717,525), 29/419,593 (now U.S. Design Pat. D730,628), and 29/419,596 (now U.S. Design Pat. No. D717,024) all filed on Apr. 30, 2012, and which are all titled HEADGEAR ACCESSORY, the entire content of each being incorporated herein by reference in its entirety, and the benefit of priority of each is claimed herein.

TECHNICAL FIELD

The present patent application relates to headgear, and more particularly, to accessories that can be used with headgear.

BACKGROUND

A variety of headgear has been developed for, military, work, and recreational purposes. In some cases, headgear can be used to protect the wearer from the elements such as wind, rain, cold, and heat. Headgear features such as a brim for a baseball cap have also been developed to help protect the wearer from potentially harmful ultraviolet rays of the sun.

OVERVIEW

Headgear accessories are disclosed that can be used as a shield to protect the wearer's ears and neck from exposure to the elements, including the sun's UV rays. The present inventor has recognized that traditional headgear features such as a hat brim may not protect the wearer's ears and neck adequately, and clothing and other items such as a bandana can have drawbacks (e.g., are difficult to seat properly, are difficult to wear in an effective manner for extended periods, may be too confining in certain weather conditions, may offer only limited anatomical protection) as well. In view of these and other concerns, the present inventor has recognized headgear accessories and accessory attachment features that can be utilized to address some or all of these concerns. Thus, the present inventor has recognized a headgear accessory with an attachment mechanism that can allow the accessory to be easily attached to and detached from headgear. The accessory can be worn with various types of headgear such as headgear used in recreational, work, and military settings. The accessory can also be sized to the individual wearer, to overlay the area to be protected in an effective manner. The accessory can be formable so as to be configured to conform to the contours of the headgear, head, ears, and neck of the wearer.

In one example, a headgear accessory is provided that can have a shade and an attachment member. The shade can be configured of a formable material adapted to cover a rear portion of the head and a rear portion of the neck of a wearer. The shade can have at least one aperture disposed adjacent a first end thereof. The attachment mechanism can include a snap configured to be insertable in the at least one aperture and a spring loaded grasping mechanism adapted to couple with the snap to attach the spring loaded grasping mechanism to the shade.

In another example, a system is disclosed that can include a shade, a plurality of button snaps, and a plurality of clips.

The shade can be configured of a formable material adapted to cover a rear portion of the head and a rear portion of the neck of a wearer. The shade can have a plurality of apertures disposed adjacent a first headgear interfacing end thereof and can have one or more passages from a first side surface to a second side surface of the shade that are configured to allow for an increased passage of air. Each button snap can have a male feature configured to be insertable in one of the plurality of apertures and can extend from the first side surface to the second side surface of the shade. Each clip can have a female feature adapted to couple with one of the male features.

In yet another example, a headgear accessory is provided that can have a shade and attachment members. The shade can be configured of a formable material adapted to cover a rear portion of the head and a rear portion of the neck of a wearer. The shade can have four or more apertures disposed along a reinforced first end thereof. The attachment mechanism can include four or more snaps each configured to be insertable in one of the four or more apertures and four or more spring loaded grasping mechanisms each adapted to couple with one of the snaps to attach the spring loaded grasping mechanism to the formable shade.

These and other examples and features of the present apparatuses will be set forth in part in the following Detailed Description. This overview is intended to provide a summary of subject matter of the present patent application. It is not intended to provide an exclusive or exhaustive removal of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present application relates to headgear accessories and to attachment mechanisms used to attach the headgear accessories to headgear. In one example, headgear accessory is provided that can have a shade and an attachment member. The shade can be configured of a formable material adapted to cover a rear portion of the head and a rear portion of the neck of a wearer. The shade can have at least one aperture disposed adjacent a first end thereof. The attachment mechanism can include a snap configured to be insertable in the at least one aperture and a spring loaded grasping mechanism adapted to couple with the snap to attach the spring loaded grasping mechanism to the shade.

Other examples not specifically discussed herein with reference to the FIGURES can be utilized. The disclosed headgear accessory can be of varying lengths and widths as desired. In other examples, panels in the shade of the headgear accessory can be provided to facilitate breathability of the headgear accessory. Additionally, although shown in reference to recreational headgear in some FIGURES, the headgear accessory can be utilized with a variety of headgear including headgear for construction workers, policemen, delivery persons, farmers, farm workers, military personnel, etc. (virtually any individual with headgear who might experience extended exposure to the sun).

Figure 1:
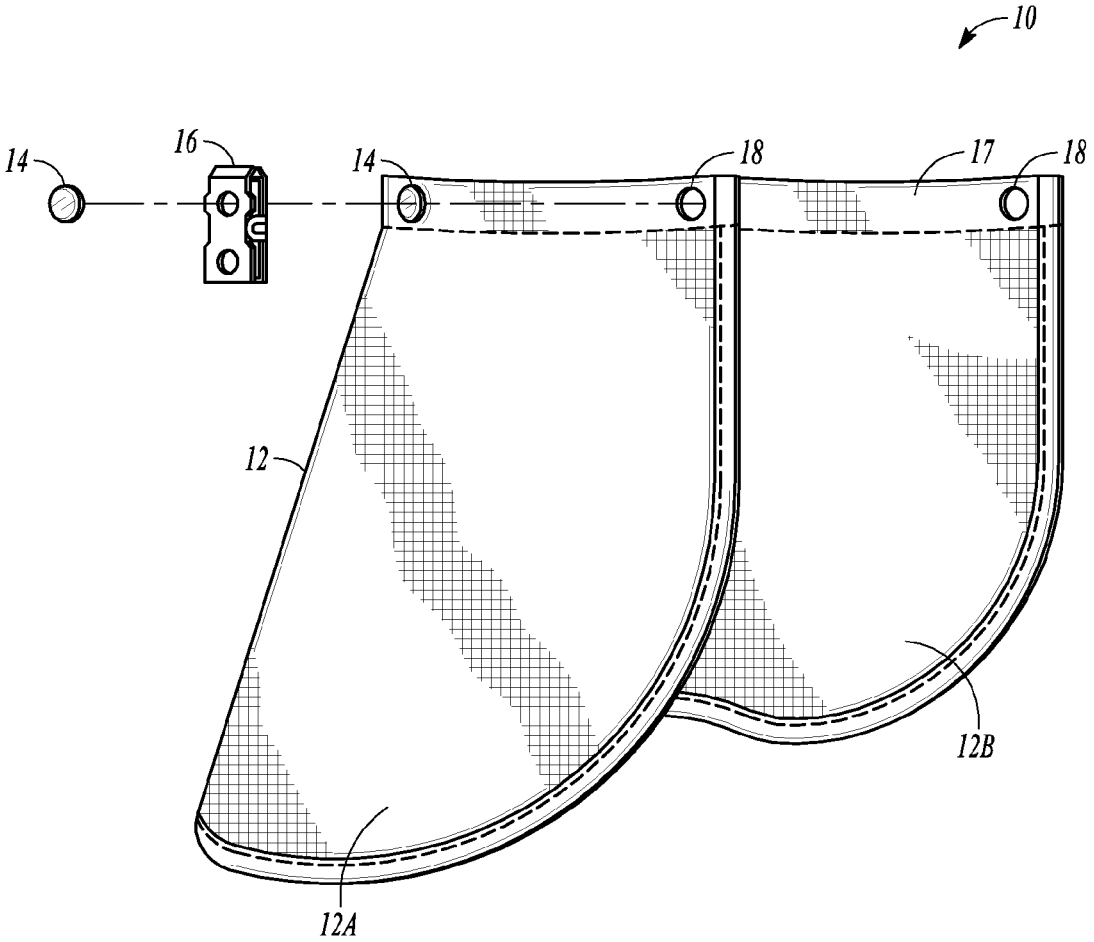
FIG. 1 is perspective view of a headgear accessory including an exploded example of an attachment mechanism according to an example of the present application.

FIG. 1 shows a perspective view of a headgear accessory 10 according to one example of the present disclosure. The headgear accessory 10 can include a shade 12, a snap 14, and a spring loaded grasping mechanism 16. As shown in FIG. 1, one snap 14 and one spring loaded mechanism 16 are exploded from the headgear accessory 10. Another snap 14 is illustrated attached to the headgear accessory 10. Other snaps and spring loaded mechanisms are not illustrated but can be used in some cases.

The shade 12 can be configured of a formable material (e.g. fabric such as mesh, silk, cotton, polyester, a blend of one or more thereof, etc.) adapted to cover a rear portion of the head and a rear portion of the neck of a wearer. The material can be of a type that provides sun protection (e.g., blocks, disrupts, or dissipates) UV and other potentially harmful rays that could be harmful to the wearer. In some cases, the material can be formed of a material with an Ultraviolet Protection Factor (UPF) rating of 15 to 50+.

The shade 12 can have a first end 17 that can be thickened or otherwise reinforced, for example, by folding over the fabric and stitching or otherwise joining it together. The first end 17 can be adapted to interface with headgear. The shade 12 can have at least one aperture 18 therein. In the example, the aperture 18 can comprise a plurality of apertures disposed adjacent the first end 17. The apertures 18 can be sized to receive the snap 14 therein. Thus, each snap 14 can be insertable in a respective corresponding single aperture 18. More particularly, the snap 14 can include a reduced diameter male portion 15A (FIG. 2) adapted to be insertable through the shade 12 from a first side surface 12A to a second side surface 12B thereof. A button portion 15B (FIG. 2) of the snap 14 can have an increased diameter relative to the male portion 15A and can be adapted to abut with the first side surface 12A of the shade 12 and hold the second side surface 12B against the spring loaded mechanism 16.

Figure 2:
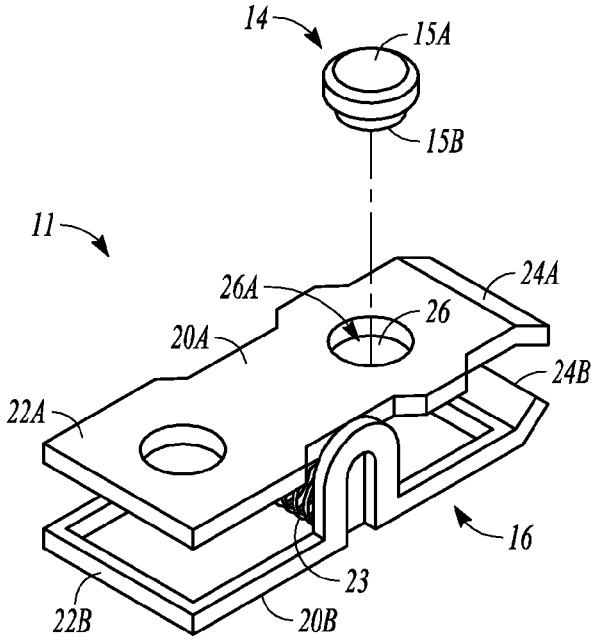
FIG. 2 is a perspective view of the attachment mechanism of FIG. 1.

As shown in FIGS. 1 and 2, the spring loaded grasping mechanism 16 can be adapted to couple with the snap 14 to attach the spring loaded grasping mechanism 16 to the shade 12. More particularly, FIG. 2 shows an attachment mechanism 11 comprising the snap 14 and the spring loaded grasping mechanism 16 according to one example. According to the example, the spring loaded grasping mechanism 16 can comprise a clip and the snap 14 comprises a button snap. However, in other examples, the headgear accessory 10 can be attached to the headgear by other mechanisms such as Velcro®, plastic strips, acrylic strips, buttons, rivets, grommets, etc.

As discussed with reference to FIG. 1, the snap 14 can include a male feature 15A that is insertable through the shade 12 (FIG. 1) from a first side surface 12A (FIG. 1) to a second side surface 12B (FIG. 1) thereof. The male feature 15A is adapted to be received in a female feature 26A in the spring loaded grasping mechanism 16.

Figure 3:
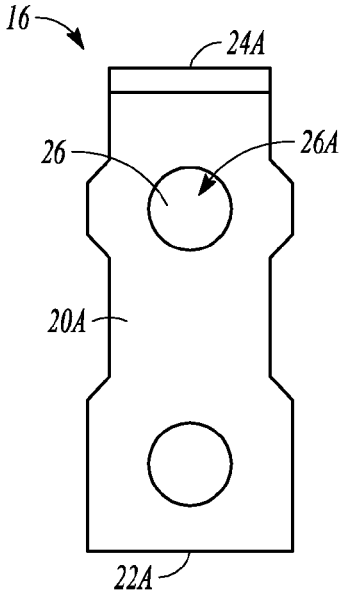
FIG. 3 is a plan view of a first side of a portion of the attachment mechanism of FIGS. 1 and 2.

FIG. 3 shows a plan view of the spring loaded grasping mechanism 16 according to the example discussed in FIGS. 1 and 2. Thus, FIGS. 2 and 3 illustrate the spring loaded grasping mechanism 16 can include the female feature 26A (also shown in FIG. 2) such as an aperture 26 disposed in a first portion 20A of the spring loaded grasping mechanism 16 between a first end 22A and a second end 24A. The first portion 20A of the spring loaded grasping mechanism 16 can form the aperture 26 at substantially an enlarged middle portion thereof. The aperture 26 can be disposed adjacent a spring 23 of the spring loaded grasping mechanism 16. As shown in FIG. 2, the spring 23 can be disposed between the first portion 20A and a second portion 20B. The second portion 20B can have a design similar to the first portion 20A, with a first end 22B and an opposing second end 24B.

Figure 4:
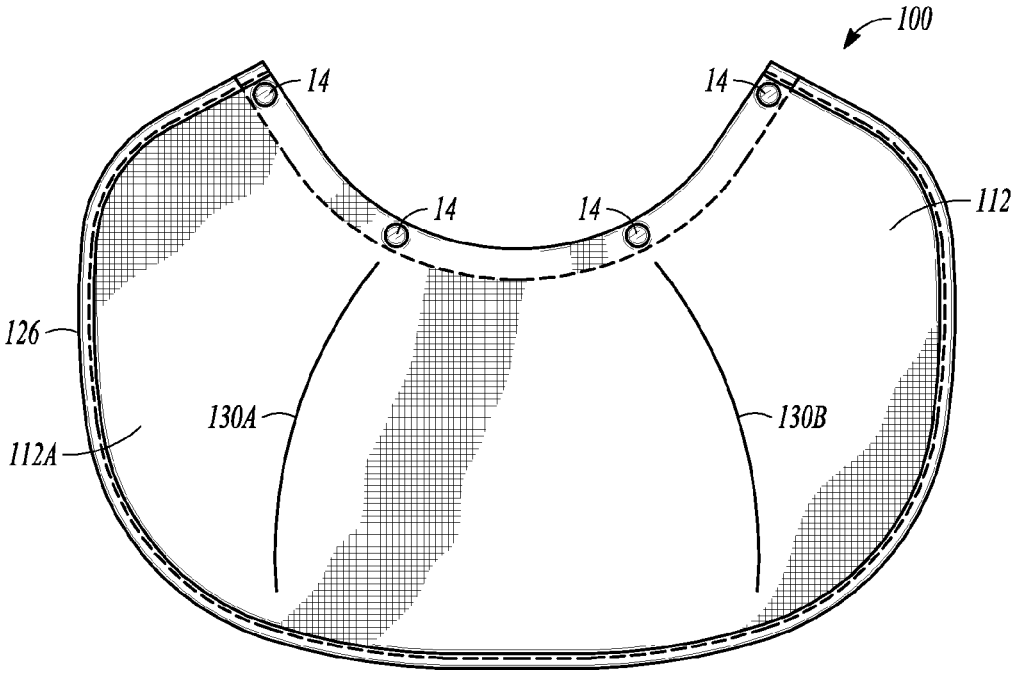
FIG. 4 is a plan view of a first side of a headgear accessory according to another example of the present application.
Figure 5:
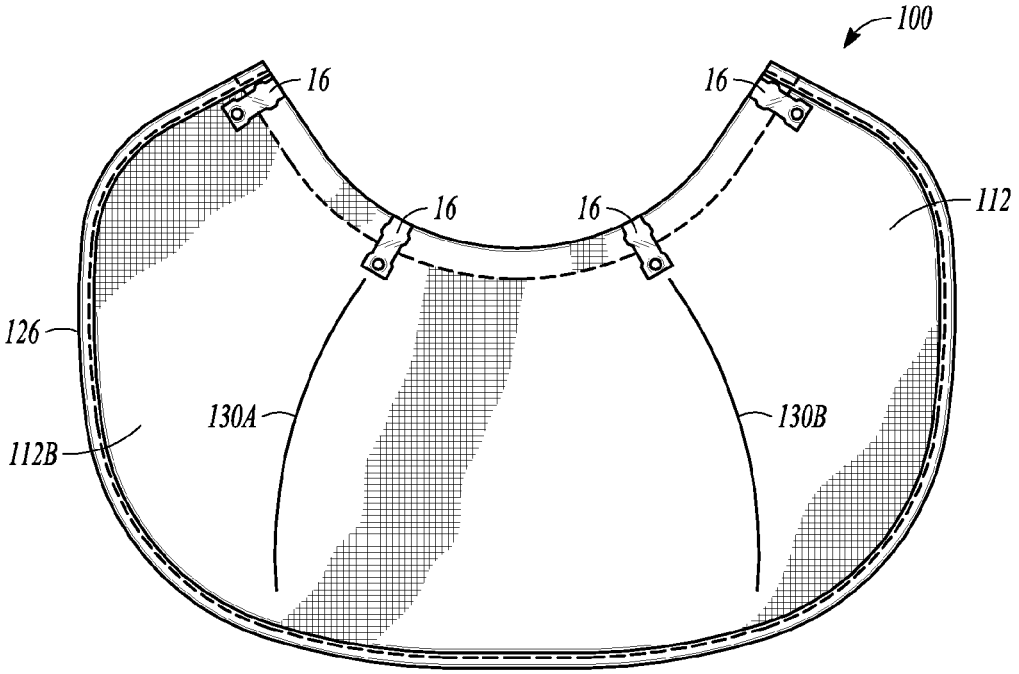
FIG. 5 is a plan view of a second side of the headgear accessory of FIG. 4.

FIGS. 4 and 5 illustrate a headgear accessory 100 according to another example. FIG. 4 illustrates the headgear accessory 100 from a first perspective showing a first side surface 112A of a shade 112. FIG. 5 illustrates the headgear accessory 100 from a second perspective showing a second side surface 112B of the shade 112. The construction, shape, and other characteristics of the headgear accessory 100 can be similar to those of headgear accessory 10 (FIG. 1). Thus, the headgear accessory 100 will not be discussed in great detail. It should be noted that headgear accessory 100 can include previously described components such as snaps 14 (FIG. 4) and spring loaded grasping mechanisms 16 (FIG. 5).

FIGS. 4 and 5 illustrate that the shade 112 can have one or more edges 126 that are reinforced with bias tape, fabric, or other material. As illustrated in the example of FIGS. 4 and 5, the shade 112 can include passages 130A and 130B through the shade 112 from the first side surface 112A to the second side 112. The passages 130A and 130B can provide for increased air circulation to the neck of the wearer. The passages 130A and 130B can comprise slits that can be 5 to 6 inches in length and can be curved in extent from a first end to a second end. Although illustrated as slits in FIGS. 4 and 5, the passages can comprise panels, windows, mesh filled areas or other types of openings that can provide for increased air circulation to the neck.

Figure 6:
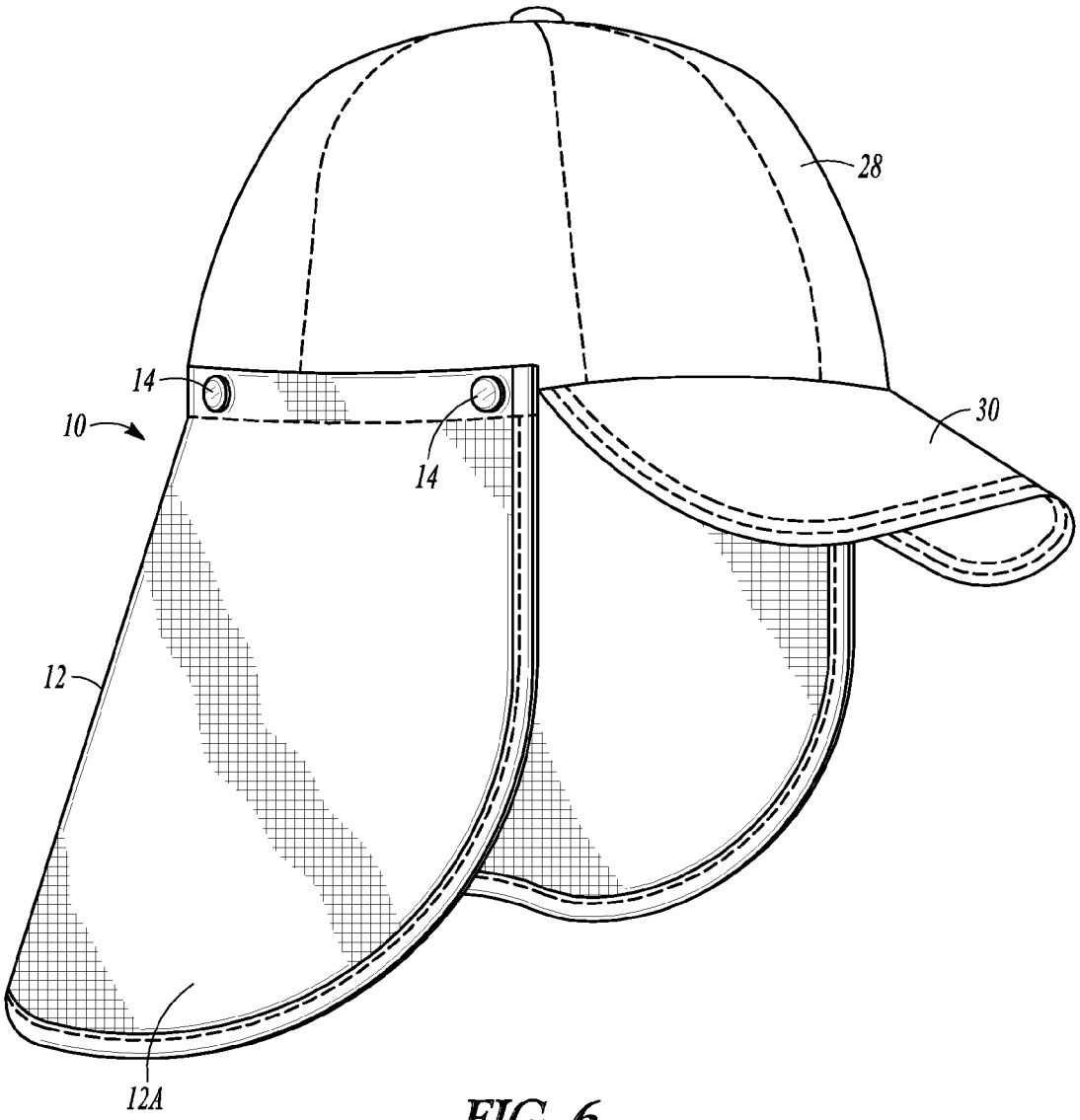
FIG. 6 is a perspective view of the headgear accessory of FIG. 1 attached to a headgear according to an example of the present application.
Figure 6A:
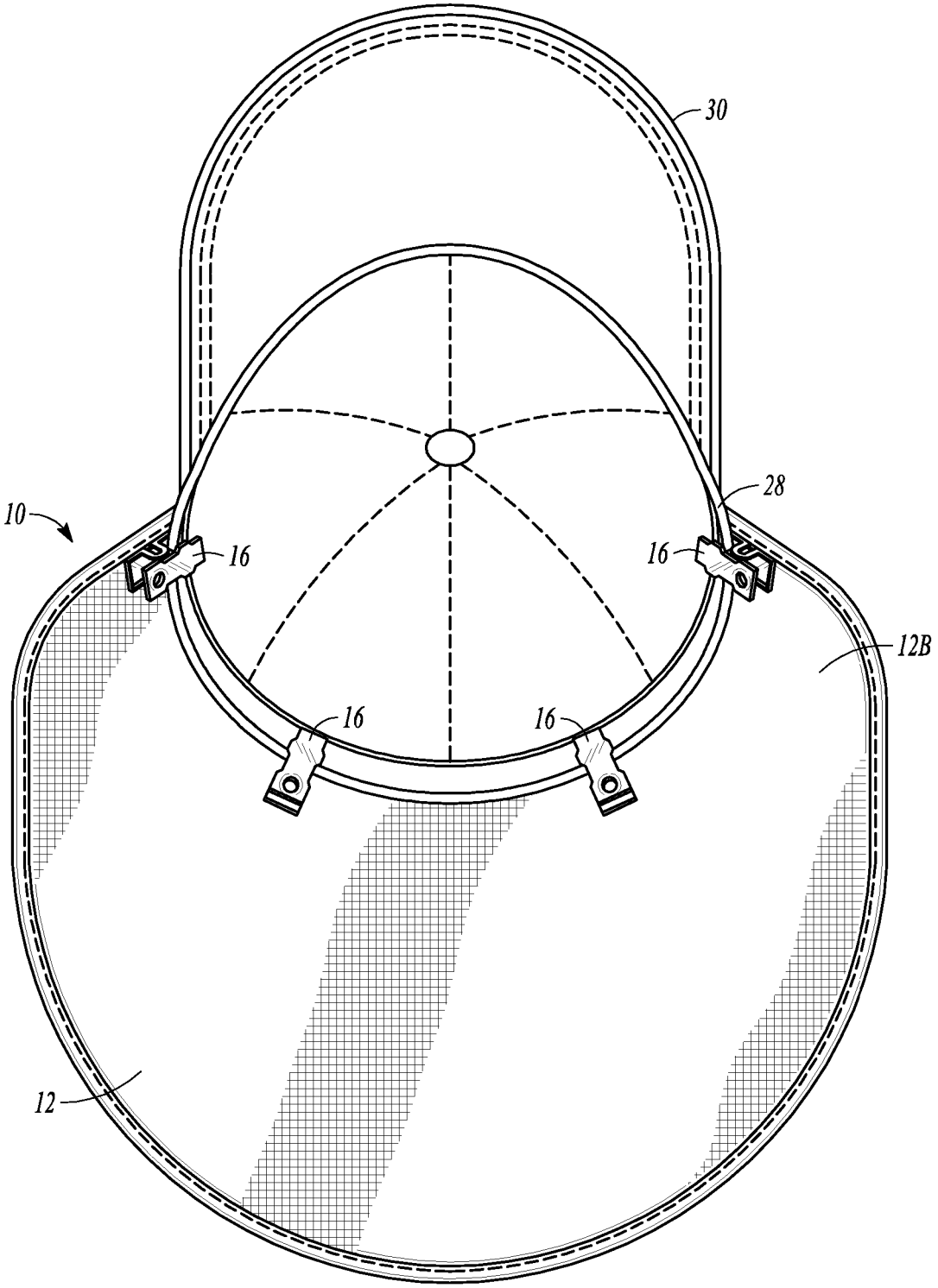
FIG. 6A is a plan view of a bottom side of the headgear accessory and the headgear of FIG. 6.

FIGS. 6 and 6A illustrate the headgear accessory 10 previously described attached to a headgear 28 adjacent and behind a brim 30 thereof. As such, the snaps 14 (FIG. 6) can extend through the shade 12 from the first side surface 12A (FIG. 6) to the second side surface 12B (FIG. 6A) to couple to the spring loaded grasping mechanisms 16 (FIG. 6A) which can grasp or otherwise be attached to the headgear 28 as illustrated in FIGS. 6 and 6A. The arrangement shown allows the spring loaded grasping mechanisms 16 to be arranged to either side of the wearer's ears. The headgear accessory 10 can be attached to the headgear 10 by the snaps 14 and the spring loaded grasping mechanisms 16. The headgear accessory 10 can be detached from the headgear 10 by uncoupling (e.g., unsnapping) the snaps 14 from the spring loaded grasping mechanisms 16.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A headgear accessory comprising:

a shade configured of a formable material adapted to cover a rear portion of the head and a rear portion of the neck of a wearer, the shade having at least one aperture disposed adjacent a first end thereof, the at least one aperture passing through a thickened portion that comprises a reinforced area where the shade is doubled over itself and joined together;

an attachment mechanism including a snap having a male feature configured to be insertable in the at least one aperture and extend through the shade from a first side to a second side thereof; and a spring loaded grasping mechanism having an aperture positioned at substantially a middle of the thereof, wherein the male feature is insertable into the aperture of the spring loaded grasping mechanism to couple the spring loaded grasping mechanism to the formable shade, and wherein the aperture is disposed adjacent a spring of the spring loaded grasping mechanism.

2. The headgear accessory of claim 1, wherein the shade includes at least one surface configured to display a logo or insignia.

3. The headgear accessory of claim 1, wherein the shade defines one or more passages from a first side surface to a second side surface.

4. A system comprising:

a shade configured of a formable material adapted to cover a rear portion of the head and a rear portion of the neck of a wearer, the shade having a plurality of apertures disposed adjacent a first headgear interfacing end thereof, the plurality of apertures passing through a thickened portion of the shade, and having one or more passages from a first side surface to a second side surface that are configured to allow for an increased passage of air;

a plurality of button snaps each having a male feature configured to be insertable in one of the plurality of apertures and extend from the first side surface to the second side surface of the shade; and clips each having a female feature adapted to couple with the male feature.

5. The system of claim 4, wherein the female feature comprises an aperture disposed between a first end and a second end of the clip.

6. The system of claim 5, wherein a first portion of each clip forms the aperture at substantially a middle thereof, and wherein the aperture is disposed adjacent a spring of the clip.

7. The system of claim 4, wherein the thickened portion comprises a reinforced area where the shade is doubled over itself and joined together.

8. The system of claim 4, wherein the first side surface is configured to display a logo or insignia.

9. A headgear accessory comprising:

a shade configured of a formable material adapted to cover a rear portion of the head and a rear portion of the neck of a wearer, the shade having four or more apertures disposed at a reinforced first end thereof;

an attachment mechanism including four or more snaps each having a male feature configured to be insertable in one of the four or more apertures and extend through the shade from a first side to a second side thereof; and four or more spring loaded grasping mechanisms each one adapted to couple with one of the four or more snaps to attach the spring loaded grasping mechanism to the fonnable shade, wherein each of the spring loaded grasping mechanisms has an aperture positioned at substantially a middle of the thereof, wherein the male feature is insertable into the aperture of the spring loaded grasping mechanism to couple each of the spring loaded grasping mechanisms to the formable shade, and wherein the aperture is disposed adjacent a spring of each of the spring loaded grasping mechanisms.

10. The headgear accessory of claim 9, wherein the shade defines one or more passages from a first side surface to a second side surface.

* * * * *